US008006759B1

(12) United States Patent
Cochran, Jr. et al.

(10) Patent No.: US 8,006,759 B1
(45) Date of Patent: Aug. 30, 2011

(54) MANUFACTURE OF STRONG, LIGHTWEIGHT, HOLLOW PROPPANTS

(75) Inventors: Joe K. Cochran, Jr., Marietta, GA (US); Thomas J. Pavliscak, Palos Verdes, CA (US); Carol Ann Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 284 days.

(21) Appl. No.: 11/867,174

(22) Filed: Oct. 4, 2007

Related U.S. Application Data

(60) Provisional application No. 60/849,476, filed on Oct. 5, 2006.

(51) Int. Cl.
*E21B 43/267* (2006.01)

(52) U.S. Cl. ..... 166/280.2

(58) Field of Classification Search ..... None
See application file for complete search history.

(56) References Cited

U.S. PATENT DOCUMENTS

| | | | | |
|---|---|---|---|---|
| 6,148,911 | A * | 11/2000 | Gipson et al. | 166/248 |
| 2006/0124304 | A1 * | 6/2006 | Bloess et al. | 166/285 |
| 2007/0166541 | A1 * | 7/2007 | Smith et al. | 428/402 |

* cited by examiner

*Primary Examiner* — Zakiya W. Bates
(74) *Attorney, Agent, or Firm* — Donald K. Wedding

(57) ABSTRACT

An ultra strong, hollow sintered, impervious, metallic shell for use in structural applications including proppants for hydraulic fracturing. The shell is made of a maraging steel, low alloy steel, or stainless steel with a crush strength of about 3,000 psi or greater and a density of about 0.6 g/cm$^3$ to about 2.5 g/cm$^3$.

5 Claims, 4 Drawing Sheets

MANUFACTURE OF STRONG, LIGHTWEIGHT, HOLLOW PROPPANTS

RELATED APPLICATION

Priority is claimed under 35 U.S.C. 119(e) for U.S. Provisional Application Ser. No. 60/849,476, filed Oct. 5, 2006.

INTRODUCTION

This invention relates to high strength, lightweight shells and methods of manufacturing such shells. More particularly, this invention relates to the manufacture of strong, lightweight metallic hollow shells and the use of such shells as proppants in hydraulic fracturing. This invention is described herein with reference to a hollow metallic sphere, but other geometric shapes are contemplated. Although the invention is described with reference to proppants, the hollow shells of this invention have utility in other applications including but not limited to structural applications, fillers, and heat sinks.

PROPPANT BACKGROUND

Hydraulic fracturing is a means of creating fractures emanating from the well bore in a producing formation to provide increased flow channels for production. A viscous fluid containing a proppant such as sand is injected under high pressure until the desired fracturing is achieved. The pressure is then released allowing the fluid to return to the well. The proppant, however, remains in the fractures preventing them from closing.

Proppants are particulates that resist high temperature, pressure, and closure stresses present in the formation. If proppants fail to withstand the closure stresses of the formation, they disintegrate to produce fines or fragments, which reduce the permeability of the propped fracture.

In the prior art, proppants include silica sand, glass beads, walnut shells, and aluminum microspheres. Based on a balance of cost and compressive strength, silica sand, commonly known as frac-sand, is a widely used proppant in fracturing. However, its use is limited to a depth with closure stresses of about 41 MPa (Mega Pascal). One MPa equals one million Pascals. One Pascal equals the force of one Newton per square meter area. Beyond this depth resin-coated and ceramic proppants are used. Resin-coated and ceramic proppants are generally limited to closure stresses of about 55 MPa and 83 MPa, respectively.

According to a study for the United States Department of Energy, published in April 1982 (Cutler and Jones, 'Lightweight Proppants for Deep Gas Well Stimulation' DOE/BC/10038-22), ideal proppants for hydraulic fracturing should have a specific gravity less than 2.0, be able to withstand closure stresses of 138 MPa, be chemically inert in brine at temperatures up to 200° C., have perfect sphericity, cost the same as sand on a volume basis, and have a narrow proppant size distribution. The report concludes that such a proppant is not likely to be forthcoming in the foreseeable future.

PROPPANT PRIOR ART

U.S. Pat. No. 4,493,875 (Beck et al.) discloses the manufacture of lightweight composite particles, the core of which is a conventional proppant particle, such as silica sand. The core has a thin coating containing hollow glass microspheres. Proppant particles manufactured in accordance with Beck et al. have densities ranging from 1.3 to 2.5 g/cm$^3$. The Beck et al. proppants are not much stronger than the core particle itself and are expensive to manufacture because of the cost of the resin and hollow glass spheres.

U.S. Pat. No. 5,030,603 (Rumpf et al.) discloses the manufacture of lightweight ceramic proppants with specific gravities ranging from 2.65 to 3.0. These are made from calcined Kaolin clay having particle sizes of less than 8 microns. The clay is mixed with an organic binder, pelletized and sintered at 1,400° C. The proppants have a relatively high apparent specific gravity and are limited to closure stresses of 55 MPa.

U.S. Pat. No. 5,120,455 (Lunghofer) discloses the manufacture of lightweight ceramic proppants with a density of approximately 2.65 g/cm$^3$ by sintering a mixture largely containing alumina and silica at 1,200° C. to 1,650° C. The proppants show significant conductivity at closure stresses of 83 MPa. A disadvantage is that the proppants have a relative high apparent specific gravity.

U.S. Pat. No. 6,364,018 (Brannon et al.) discloses the manufacture of resin-coated ground nut hull proppants with apparent specific gravities ranging from 1.25 to 1.35 and closure stresses of 15 MPa. This proppant is limited to shallow wells.

U.S. Pat. No. 6,753,299 (Lunghofer et al.) discloses using quartz, shale containing quartz, bauxite, talc, and wollastonite as raw materials. The proppant contains as much as 65% quartz, and has yielded sufficient strength to be used in wells with closure stresses up to 69 MPa. The density of the proppant is approximately 2.62 g/cm$^3$. Lunghofer et al. '299 provides improvements over U.S. Pat. No. 5,120,455 (Lunghofer), cited above, by reducing the density of the proppants and by decreasing costs with increased silica content.

U.S. Pat. No. 7,160,844 (Urbanek) discloses the manufacture of lightweight ceramic proppants with apparent specific gravities ranging from 1.4 to 1.9 using sol-gel processes. The reference discloses the preferred use of two exothermic chemical compositions commonly referred to as 'Geopolymers' and 'Phosphate Cements'.

U.S. Patent Application 2006/0016598 (Urbanek) discloses the manufacture of lightweight ceramic proppants with specific gravities ranging from 1.0 to 2.9 by introducing micro- and mesopores into ceramics. The reference discloses the use of sol-gel processes to form porous proppants. At the present time, commercially available lightweight ceramic proppants have a specific gravity of around 2.7. The proppants are typically manufactured as disclosed in U.S. Pat. No. 5,120,455, cited above.

PRIOR ART METHODS OF PRODUCING MICROSPHERES

A wide variety of methods or processes have been used in the prior art to produce solid or hollow shells also known as spheres or microspheres. Solid microspheres have been formed from glass, ceramic, metal, plastic and other inorganic and organic materials. Hollow microspheres have been made glass and ceramics. Varying methods and processes for producing solid and hollow microspheres have been disclosed and practiced in the prior art. Some of the prior art methods for producing microspheres are disclosed below and are incorporated herein by reference.

Some methods used to produce hollow glass microspheres incorporate a so-called blowing gas into the lattice of a glass while in frit form. The frit is heated and glass bubbles are formed by the in-permeation of the blowing gas. Microspheres formed by this method have diameters ranging from about 5 μm to approximately 5,000 μm. This method produces shells with a blowing gas enclosed in the shell. The blowing gases typically include $SO_2$, $CO_2$, and $H_2O$.

Methods of manufacturing glass frit for forming hollow microspheres are disclosed by U.S. Pat. Nos. 4,017,290 (Budrick et al.) and 4,021,253 (Budrick et al.), Budrick et al. '290 discloses a process whereby occluded material gasifies to form the hollow microsphere.

Hollow microspheres are disclosed in U.S. Pat. Nos. 5,500,287 (Henderson) and U.S. Pat. No. 5,501,871 (Henderson). According to Henderson '287, the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow shell as described in step D in column 3 of Henderson '287. Henderson '287 and '871 are limited to gases of small molecular size.

U.S. Pat. No. 4,257,798 (Hendricks et al.) discloses a method for manufacturing small hollow glass spheres filled with a gas introduced during the formation of the spheres, and is incorporated herein by reference. The gases disclosed include argon, krypton, xenon, bromine, DT, hydrogen, deuterium, helium, hydrogen, neon and carbon dioxide. Other Hendricks patents for the manufacture of glass spheres include U.S. Pat. Nos. 4,133,854 and 4,186,637, both incorporated herein by reference.

Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder, which close and detach the elongated cylinder from the coaxial blowing nozzle.

Surface tension forces acting on the detached cylinder form the latter into a spherical shape, which is rapidly cooled and solidified by cooling means to form a glass microsphere.

In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference. The microspheres may also be produced using a centrifuge apparatus and method as disclosed by U.S. Pat. No. 4,303,433 (Torobin) and WO8000695A1 (Torobin), both incorporated herein by reference.

Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference. U.S. Pat. Nos. 3,607,169 (Coxe) and U.S. Pat. No. 4,303,732 (Torobin) disclose an extrusion method in which a gas is blown into molten glass and individual shells are formed. As the shells leave the chamber, they cool and some of the gas is trapped inside. Because the shells cool and drop at the same time, the shells may not form uniformly. It is also difficult to control the amount and composition of gas that remains in the shell. U.S. Pat. No. 4,349,456 (Sowman), incorporated by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried and fired to convert them into microspheres. Prior to firing, the microcapsules are sufficiently porous that, if placed in a vacuum during the firing process, the gases can be removed and the resulting microspheres will generally be impermeable to ambient gases. The shells formed with this method may be filled with a variety of gases and pressurized from near vacuums to above atmosphere. Shell uniformity may be difficult to control with this method.

U.S. Patent Application 2002/0004111 (Matsubara et al.), incorporated by reference, discloses a method of preparing hollow glass microspheres by adding a combustible liquid (kerosene) to a material containing a foaming agent. Methods for forming microspheres are also disclosed in U.S. Pat. Nos. 3,848,248 (Maclntyre), 3,998,618 (Kreick et al.), and 4,035,690 (Roeber), discussed above and incorporated herein by reference. Methods of manufacturing hollow microspheres are disclosed in U.S. Pat. Nos. 3,794,503 (Netting), 3,796,777 (Netting), 3,888,957 (Netting), and 4,340,642 (Netting et al.), all incorporated herein by reference. Other prior art methods for forming microspheres are disclosed in the prior art including U.S. Pat. Nos. 3,528,809 (Farnand et al.), 3,957,194 (Farnand et al.), 4,025,689 (Kobayashi et al.), 4,211,738 (Genis), 4,307,051 (Sargeant et al.), 4,569,821 (Duperray et al.) 4,775,598 (Jaeckel), and 4,917,857 (Jaeckel et al.), all of which are incorporated herein by reference.

These references disclose a number of methods which comprise an organic core such as naphthalene or a polymeric core such as foamed polystyrene which is coated with an inorganic material such as aluminum oxide, magnesium, refractory, carbon powder, and the like. The core is removed by pyrolysis, sublimation, or decomposition and the inorganic coating sintered at an elevated temperature to form a sphere or microsphere. Farnand et al. '809 discloses the production of hollow metal spheres by coating a core material such as naphthalene or anthracene with metal flakes such as aluminum or magnesium. The organic core is sublimed at room temperature over 24 to 48 hours. The aluminum or magnesium is then heated to an elevated temperature in oxygen to form aluminum oxide or magnesium oxide. The core may also be coated with a metal oxide such as aluminum oxide and reduced to metal. The resulting hollow spheres are used for thermal insulation, plastic filler, and bulking of liquids such as hydrocarbons.

Farnand '194 discloses a similar process comprising polymers dissolved in naphthalene including polyethylene and polystyrene. The core is sublimed or evaporated to form hollow spheres or microballoons. Kobayashi et al. '689 discloses the coating of a core of polystyrene with carbon powder. The core is heated and decomposed and the carbon powder heated in argon at 3000° C. to obtain hollow porous graphitized spheres. Genis '738 discloses the making of lightweight aggregate using a nucleus of expanded polystyrene pellet with outer layers of sand and cement. Sargeant et al. '051 discloses the making of light weight-refractories by wet spraying core particles of polystyrene with an aqueous refractory coating such as clay with alumina, magnesia, and/or other oxides. The core particles are subject to a tumbling action during the wet spraying and fired at 1730° C. to form porous refractory. Duperray et al. '821 discloses the making of a porous metal body by suspending metal powder in an organic foam which is heated to pyrolyze the organic and sinter the metal. Jaeckel '598 and Jaeckel et al. '857 disclose the coating of a polymer core particle such as foamed polystyrene with metals or inorganic materials followed by pyrolysis on the polymer and sintering of the inorganic materials to form the sphere. Both disclose the making of metal spheres such as copper or nickel spheres which may be coated with an oxide such as aluminum oxide. Jaeckel et al. '857 further discloses a fluid bed process to coat the core.

Ceramic Shells

Hollow and solid shells including microspheres have been made of ceramic. The utility of ceramic shells depends on the application and material properties such as bend and compressive strength, thermal shock resistance, thermal expansion, modulus of elasticity, fracture toughness, thermal conductivity, hardness, density, catalytic activity, and chemical inertness. Although many of these material properties are available in dense ceramics, the desired properties are lost once pores are introduced. It has been observed, for instance, that compressive strength decreases exponentially with increasing pore volumes (see Ryshekewitch and Duckworth, 'Compression Strength of Porous Sintered Alumina and Zirconia', *Journal of the American Ceramic Society,* 36 [2] 65, 1953 and *Journal of the American Ceramic Society,* 36 [2] 68, 1953).

Pore volumes can be controlled to a certain degree through initial ceramic particle properties and sintering profiles. Extended sintering periods and high temperatures, however, generally decrease the amount of pores present (see Deng, Fukasawa, Ando, Zhang and Ohji, 'Microstructure and Mechanical Properties of Porous Alumina Ceramics Fabricated by the Decomposition of Aluminum Hydroxide', *Journal of the American Ceramic Society*, Vol. 84 (11), 2638, 2001). Sintering, therefore, must be restricted at times to achieve certain pore volumes while other mechanical properties are neglected.

Because porosity is very sensitive to ceramic precursor properties, sintering temperatures, and hold times, it is difficult to produce strong ceramic hollow shells. Ideally, lightweight ceramics would be produced according to a method which controls pore size, pore size distribution, and total pore volume independent of the sintering process. Such method would also permit sintering of ceramic precursors to near theoretical density and thereby improvements of mechanical properties, including compressive strength.

In U.S. Pat. No. 4,777,153 (Sonuparlak et al.), colloidal suspensions of polymeric microspheres of selected sizes and shapes are consolidated with aluminum oxide particles to form compacts. Upon heating, the microspheres are decomposed to leave pores. The resulting structure is then sintered to form a porous ceramic body with a plurality of pores, typically of the same size and shape. The pores are evenly distributed and noncontiguous throughout the ceramic body. A disadvantage of this process is that extended heating periods are required to decompose the polymeric microspheres into stable pore structures.

In U.S. Pat. No. 6,156,091 (Casey), porosity of ceramics is controlled by the volume percentage, particle size, and particle shape of a fugitive material, which is added to the original refractory material slurry. The method is used to fabricate setter tiles and contact sheets. The fugitive phase is used independently to introduce porosity or in conjunction with partial densification. Since porosity is not solely dependent upon partial sintering, higher porosity levels can be achieved with less impact on subsequent mechanical properties of the sintered refractory material. This prior art uses carbon black as a pore former to improve mechanical properties other than compressive strength and to control pore volumes of ceramics containing contiguous pores after sintering. The use of inert atmospheres to control porosity is not disclosed.

Although various forms of ceramic have been used in structural and proppant applications, they have disadvantage in that they are heavy, and have a specific gravity density that is not optimum for proppant applications. For example, ceramic spheres as disclosed in U.S. Patent Application 2006/0177661 (Smith et al.) may be formed with the requisite specific density, but do not have the requisite crush strength.

THE INVENTION

In accordance with this invention, there is prepared a high strength, lightweight, hollow proppant with a sintered, impervious, metallic shell. More particularly, there is produced metallic proppants having shell strength and ductility sufficient to prevent complete collapse of the shells so as to provide a path through which oil and gas may flow.

Hollow metallic spheres have the requisite crush strength and are formed with the requisite specific density as disclosed herein. Furthermore, the hollow metallic proppants are made from metals, metal alloys, and/or common metal compounds using a low cost process.

The hollow metallic proppants of this invention have a compressive strength sufficient to prevent complete collapse of oil and/or gas passages so as not to prohibit plugging of the oil and/or gas extraction. Shell materials and thicknesses are selected so as to allow proppant shell deformation under the pressure of the collapsing earth and rock passageways.

When oil is removed from porous oil passages, the passageways collapse choking off oil and/or gas flow to the drill head. After installation of the proppants of this invention into oil and/or gas passages, the hollow proppant shells deform due to force contact points deforming the shell from the pressure ground loading. The stress on the proppant shell increases to the point where the fracture load is carried by the deformed shape permitting the continued flow of oil and/or gas.

The deformed proppant provides structural support to the oil and/or gas fracture passageways while providing sufficient space between the individual proppants to allow uninterrupted flow. In one embodiment and best mode, the hollow proppant shells are spherical before being deformed by the underground stresses. The spherical shape of the proppants provides for low friction flow of large quantities of proppants into small fissures in the earth and rock through which the oil and/or gas seeps into the drill head area. The subsequent deformed shape of the proppant sphere causes or allows a plurality of proppants to interlock together into rock fissures so as to prevent the egress-deformed proppants from the fracture.

PROPPANT SHELL MATERIALS

In the practice of this invention, it is contemplated that the metallic shell may be made of metals and/or metal alloys. The shell may also be made of any suitable inorganic compounds of metals and/or metalloids, including mixtures, combinations and/or alloys thereof. Contemplated inorganic compounds of metals and metalloids include oxides, carbides, nitrides, nitrates, silicates, silicides, aluminates, phosphates, sulphates, sulfides, borates and borides.

The metals and/or metalloids may be selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, bismuth, and alloys thereof.

DETAILED DESCRIPTION OF THE DRAWINGS

Figure 1:
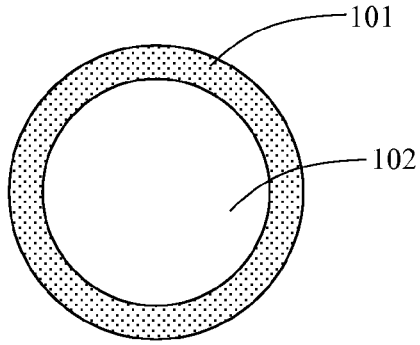
FIG. 1 is a section view of a metallic proppant manufactured in accordance with this invention.

FIG. 1 shows a schematic view of a proppant with a hollow metallic shell (101). The shell forms an impervious layer around the hollow center (102). Although FIG. 1 is shown as a hollow sphere, other geometric shapes are contemplated including hollow ellipses, prolate spheroids, oblate spheroids, scalene spheroids, hollow cylinders or discs, domes, and hexagonal and multi-faceted shapes such as clones cubes, and pyramids.

Figure 1A:
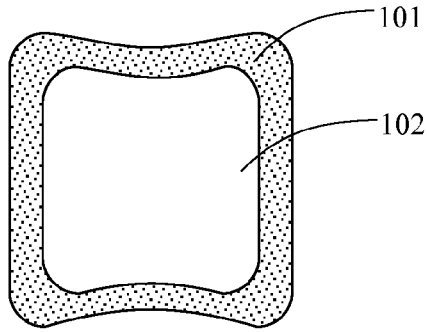
FIG. 1A is section view of a metallic proppant under medial strain.

FIG. 1A is a section view of a metallic proppant under medial strain. The shell (101) deforms from a hollow sphere into a hollow right circular cylinder at about 50% compression.

Figure 1B:
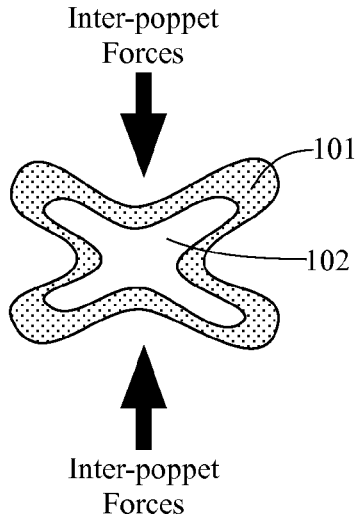
FIG. 1B is as section view of a metallic proppant in a deformed state as a result of providing structural support to underground oil passageways.

A compressed metallic sphere is shown in FIG. 1B with a compression of about 75%. The limited deformation of the plurality of shells provides porosity between the shells so as prevent complete closure of oil passageways and allow oil and gas flow to the wellhead. The shell (101) is an impervious metallic layer around the hollow center (102).

The metallic proppant shell (101) is a high strength steel selected from suitable metals or metal alloys. Materials with tensile strengths above 200,000 psi, ductility (strain to failure) above 10%, and a density of above 0.9 g/cm$^3$ to about 1.5 g/cm$^3$. Examples of contemplated steels are shown in TABLES I, II, and III.

TABLE I

AISI Grade 18Ni (200) Maraging Steel, Aged

| Component | Wt. % | Component | Wt. % | Component | Wt. % |
|---|---|---|---|---|---|
| Al | 0.1 | Mn | Max 0.1 | S | Max 0.01 |
| B | 0.003 | Mo | 3.25 | Si | Max 0.1 |
| C | Max 0.03 | Ni | 18.5 | Ti | 0.2 |
| Co | 8.5 | P | Max 0.01 | Zr | 0.01 |
| Fe | 69 | | | | |

TABLE II

AISI 4140H Steel, Low Alloy Steel, heat treated, tempered 370° C.

| Component | Wt. % |
|---|---|
| C | 0.37-0.44 |
| Cr | 0.75-1.2 |
| Fe | Min 96.585 |
| Mn | 0.65-1.1 |
| Mo | 0.15-0.3 |
| P | Max 0.035 |
| S | Max 0.04 |
| Si | 0.15-0.3 |

TABLE III

AK SteelPrecipitation Hardening Stainless Steel 15-5 PH, Condition H 900

| Component | Wt. % | Component | Wt. % | Component | Wt. % |
|---|---|---|---|---|---|
| C | Max 0.07 | Mn | Max 1 | P | Max 0.04 |
| Cr | 14-15.5 | Nb + Ta | 0.15-0.45 | S | Max 0.03 |
| Cu | 2.5-4.5 | Ni | 3.5-5.5 | Si | Max 1 |
| Fe | 71.91-79.85 | | | | |

It is contemplated that any ferrous-based composition may be used that has the mechanical properties needed for proppant applications. Compositions can be optimized for specific applications based on other properties such as resistance to oxidation, strength, and cost. Of the steels presented above, the Maraging Steel composition (TABLE I) provides the greatest strength, the low alloy steel (TABLE II) is the least costly and the hardening stainless steel (TABLE III) provides the best oxidation resistance.

In one embodiment, the proppants are coated with an organic coating, such as epoxy, furan, and phenolic resins. See U.S. Pat. No. 5,639,806 (Johnson et al.) incorporated herein by reference, including combinations of these coatings to improve proppant performance characteristics and utility. Inorganic coatings may also be applied to the sintered shell alone or in combination with organic coatings. Coatings may be used to seal any open pores connecting to the surface of sintered proppants. The coatings may be applied to the proppants with any suitable method including dipping, fluid bed, and so forth.

Maraging Steel Example

Figure 2:
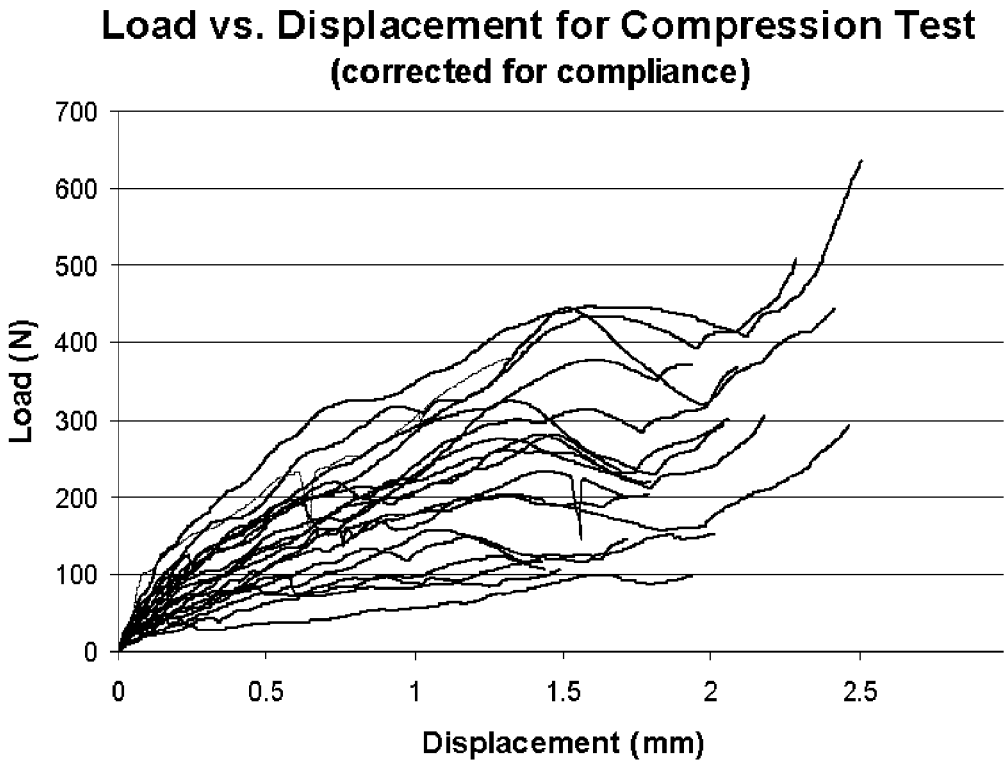
FIG. 2 is a load displacement curves for hollow metal alloy spheres.

Maraging Steel (M200) hollow spheres with a bulk density of 0.62 g/cm$^3$ were fabricated using mixtures of oxides and metal powders of Fe, Ni, Co, Mo, and Ti. These spheres averaged a sphere density of ~1.05 g/cm$^3$. Twenty spheres were loaded in compression between flat platens. FIG. 2 shows Load/Displacement curve. Load/displacement curves were generated for each sphere and weight and diameters of each sphere were recorded under a load of 8,000 psi for maraging steel, a 50% strain was observed, deforming the hollow sphere into a hollow right circular cylinder. Under a load of 200,000 psi (close to the maximum theoretical load) the hollow sphere deformed to a strain of 75%, similar to the shape illustrated in FIG. 1B. The load bearing area is $\pi dt$, where d is diameter and t is wall thickness. To determine the thickness, the relative density of the sphere was calculated from $\rho_s/\rho_o=f_v$ where $\rho_s$ is sphere density, $f_v$ is relative density, and $\rho_o$ is the density of the wall material=8.2 g/cm$^3$. Sphere density is the weight of sphere/$(4/3\cdot\pi\cdot r^3)$. To calculate thickness, t=r·fv/3. The stress on the sphere wall was calculated as load/πdt. This should normalize the stress on sphere of varying relative density and bring the stress strain curves in line. The maximum stress should correspond to the yield strength of the wall material.

Figure 3:
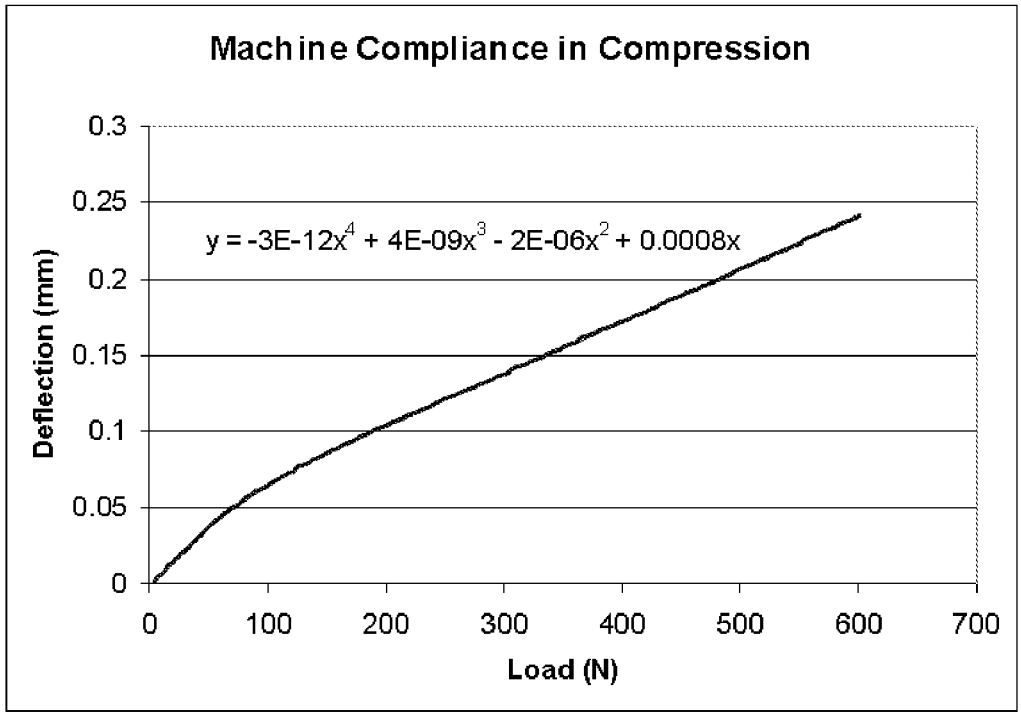
FIG. 3 is a polynomial fit of machine compliances for hollow metal alloy spheres.
Figure 4:
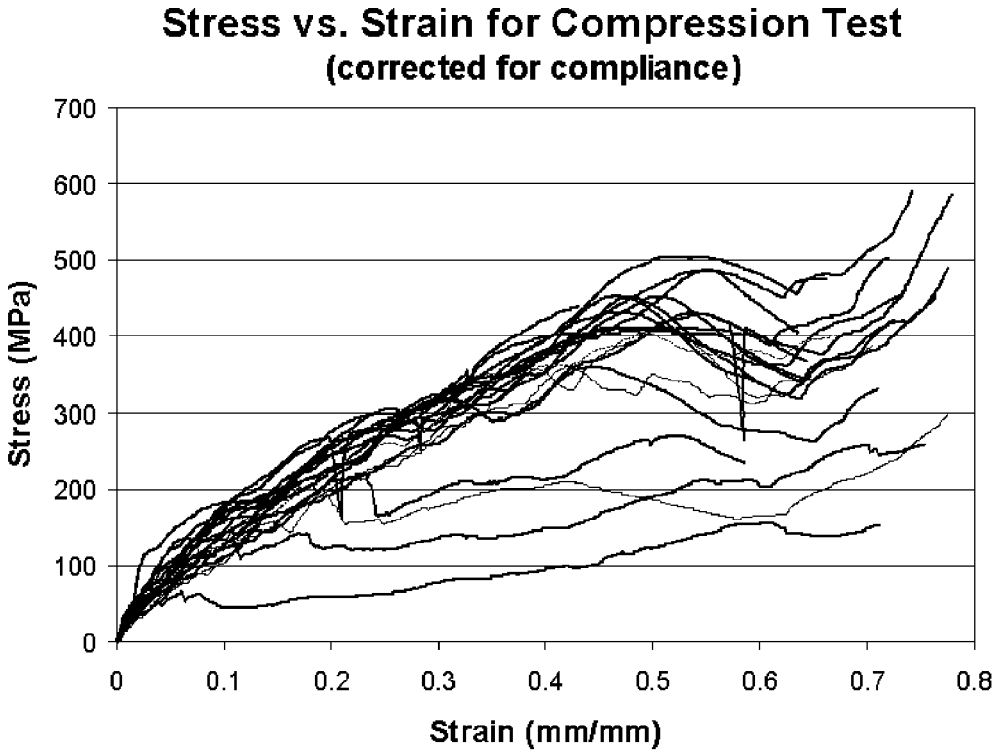
FIG. 4 is a Stress vs. Strain curve for hollow metal alloy spheres.

To correct for test machine compliance, a polynomial fit as shown in FIG. 3 was used for the relationship between load and deformation for the system using a machine compliance curve. Sphere strain wall calculated as deformation/sphere diameter. The plot of wall stress vs. strain as shown in FIG. 4 resulted in a narrow variation for all but four spheres.

The maximum load on the sphere was divided by sphere total cross sectional area, ie $L_{max}/\pi \cdot r2$. This is maximum loading stress, $G_{max}$. This was plotted vs. relative density, $f_v$, to help predict the relative density needed for proppant geological stabilization.

A maximum stress of ~55 MPa was observed at an 18% density or 1.5 g/cm$^3$. These were unaged spheres and on aging, yield stress generally increases 70%. Obviously, strength is controlled a great deal by sphere defects and perfection. It is likely that spheres with increased perfection will have increased load-carrying capability.

Although the invention is described herein with reference to proppant industry, ultra strong hollow metal or metal alloy spheres have broad applications in the formation of strong lightweight mechanical structures.

Proppant Manufacture

In accordance with this invention, there is provided a sacrificial core method for producing hollow metallic spheres for use as a proppant. The sacrificial core method allows the production of hollow metallic spheres with a diameter of about 500-microns to about 5 millimeters, which encompasses the typical useful range for proppants. The selected preforms are coated with a slurry of metallic particles such as powdered metals or metal oxides in a binder. The coated preforms are coated at an elevated temperature to remove the preform and binder, leaving a hollow metallic shell which is then sintered and sealed.

Step 1: Selecting a Preform

Organic or polymeric preforms are selected that are uniform in size and weight with a smooth surface finish. They are typically selected from organic or polymer materials that will burn out, decompose, or pyrolyze and not react with the metallic shell material or binder during the heating process. Because the preform acts as a core for the slurry, a uniform preform allows for a uniform coating. Preforms with substantially the same size and weight can be coated uniformly in a fluidizing bed. Uniform size and shape allow uniform and non-preferential agitation of the preforms as they are tumbled and presented to a spray of slurry in the fluidized bed. This will allow for a uniform coat to be applied to all of the spheres. Controlling the thickness of the coat in conjunction with controlling the size and the shape of the preform allows for control of the density and strength of the proppant.

A preform with smooth surface is desirable to provide for a uniform coat free of blemishes. Shell uniformity including a shell devoid of holes, pockets, voids, peaks, seams, "comet tails" or cracks is extremely important to the shell strength. Careful selection of the preforms will eliminate or minimize the potential for these defects and provide higher yields.

The preform is selected from material that will burn out, decompose, or pyrolyze during the subsequent heat cycle. After the preform is coated with the slurry, it undergoes a heat process in which all organics including any polymeric materials are completely burned off and only the bisque shell remains. One specific embodiment and best mode includes the use of a polystyrene core which allows for a smooth spherical preform.

Step 2: Coating the Preform with Slurry

The preforms can be coated in a fluidizing bed, drum coater or with other suitable methods. The slurry comprises a homogenous blend of powdered metallic material and binder that is coated on the preform core. A uniform coat is achieved by selecting slurry compositions that wet evenly over the preform, and dry quickly. Thin coats will tend to improve the uniformity, density, and yield of the shell.

Slurry compositions include fine metallic particles such as metals and/or metal alloys, mixed with organic binders and surfactants. In one embodiment, the particles are selected from oxides or other compounds of metals or metalloids. Metallic powder particles are also selected from metals and/or metal alloys. Mixtures of components may be used. For a metal or metal alloy proppant, it is possible to use metal or metal alloy powders, the corresponding metal oxide powders, or combinations thereof. Elements, which form easily reducible oxides, such as Fe, Ni, Co, Cu, W and Mo, can be used in the form of the oxides and then reduced to elemental metal at least in part during the sintering process. The metallic powder particles employed include metal and/or metal alloys with a particle size of about 30 nm to about 300 nm (nanometers). Finer particles tend to form impervious shells at lower sintering temperatures.

The organic binders may be contained as solutes in an aqueous dispersion and are selected from a large number of organic materials including polymers such as polyethylene, polyacrylate, polyvinyl acetate, polyvinyl alcohol, polyvinyl chloride, polybutyral, polyamide, cellulose ester, phenol resin, amino resin and epoxy resins. Particularly suitable binders include polyacrylates and cellulose esters. The aqueous dispersion has an organic binder content of about 3% to about 15% by weight relative to the metallic powder material contained in the dispersion. In a fluid bed, the duration of the processing will depend on the coating thickness desired and the temperature of the fluidizing gas, which is typically about 70° C. to about 120° C. The application and drying of the coating is generally completed in about 1 to 3 hours.

Step 3: Pyrolyzing the Organics

The foamed polystyrene spheres are treated in a fluidized bed such that a powder layer is formed in a dry state with a thickness of about 10 to about 300 microns. If the binder and the thickness of the coating are properly selected, the dried powder coating will have an adequate strength so that the core particles, which are substantially spherical, can be burned out, decomposed, and/or pyrolyzed such that the shape of the external metallic shell is not deformed. During the burn out, decomposing, or pyrolyzing of the core, the binder in the powder coating is also vaporized so that a self-supporting porous shell structure remains. This is done at temperatures of about 400° C. to about 900° C. The vaporized core and binder material escape through the porous shell. Depending upon the selected metallic powder material, the burn out, decomposition, or pyrolysis of the coated core is done in air, or inert gas or under reducing gas conditions. Heating for about 1 to 3 hours requires a temperature of about 500° C.

Step 4: Sintering the Hollow Spheres

The pyrolytic processing serves to remove the coated polymer core and at least part of the organic binder and is followed by a sintering process at a temperature of about 700° C. to about 1800° C. These pyrolytic and sintering steps may be carried out in a fluidized bed reactor. Alternatively, it may be desirable to effect the pyrolytic and sintering processing in a rotary kiln, raking furnace, or a continuous flow furnace. A conventional non-agitating furnace may be appropriate for some applications. The atmosphere in the furnace unit is a function of the metallic powder material selected to form the coating. Depending upon the selected material, it is possible to operate in a vacuum and/or under oxidizing or reducing conditions or under an inert gas. A reducing gas atmosphere such as hydrogen, and/or nitrogen allows for the production of metals or metal alloys from one or more metal oxides.

The proppants of this invention can be suspended or dispersed in any suitable fluid vehicle or carrier including a liquid or gas and flowed into the oil or gas well. Examples of liquids include water, brine, hydrocarbon, oil, crude oil, gel, foam, and combinations thereof. The weight ratio of carrier to proppant ranges from about 10,000:1 to about 1:10,000.

The proppants of this invention have a crush strength of about 3,000 psi or greater and can be used at well depths up to 25,000 feet or more. In some embodiments, the proppants have a crush strength of about 5,000 psi to about 10,000 psi. The proppants have a density of about 0.6 g/cm$^3$ to about 2.5 g/cm$^3$. In some embodiments, the proppants have a density of about 0.9 g/cm$^3$ to about 1.5 g/cm$^3$.

SUMMARY

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A method of propping open a subterranean formation fraction that comprises introducing a hollow impervious proppant shell into the subterranean formation, said proppant shell being made of a maraging steel, a low alloy steel, or a stainless steel, and having a crush strength of about 5,000 psi to about 10,000 psi, said proppant shell being spherical with a diameter of about 90 microns to about 1,600 microns and having a shell thickness of about 15 to about 120 microns.

2. The invention of claim 1 wherein the proppant contains an organic or inorganic coating.

3. A method of propping open a subterranean formation fraction that comprises introducing a hollow impervious proppant shell into the subterranean formation, said proppant shell being made of a maraging steel, a low alloy steel, or a stainless steel, and having a crush strength about 5,000 psi to about 10,000 psi, said hollow proppant shell containing a coating of organic or inorganic coating, the geometric shape of the hollow proppant shell being a sphere, an ellipse, prolate spheroid, oblate spheroid, scalene spheroid, cylinder, or dome, with a shell wall thickness of about 10 to 300 microns.

4. The invention of claim 3 wherein said proppant shell is spherical with a diameter of from about 90 microns to about 1,600 microns.

5. The invention of claim 3 wherein the shell thickness is about 15 to about 120 microns.

* * * * *